United States Patent [19]

Koizumi et al.

[11] Patent Number: 5,040,912

[45] Date of Patent: Aug. 20, 1991

[54] PRINTER HAVING A TOP COVER WITH AN ACCESS SHUTTER

[75] Inventors: Michio Koizumi; Yasuo Iwata, both of Tokorozawa; Kimihiro Kosugi, Tanashi; Kouzou Abe, Tokyo, all of Japan

[73] Assignee: Citizen Watch Co., Ltd., Tokyo, Japan

[21] Appl. No.: 287,665

[22] Filed: Dec. 20, 1988

[30] Foreign Application Priority Data

Dec. 25, 1987 [JP] Japan ..... 62-195903

[51] Int. Cl.[5] ..... B41J 29/12

[52] U.S. Cl. ..... 400/690.4; 400/616.3; 400/689

[58] Field of Search ..... 400/605, 690.4, 616.1, 400/616.2, 616.3, 616, 689, 688, 693

[56] References Cited

U.S. PATENT DOCUMENTS

| | | | |
|---|---|---|---|
| 3,410,204 | 11/1968 | Burkhard | 400/616 |
| 3,675,753 | 7/1972 | Perucca | 400/616 |
| 4,164,376 | 8/1979 | Yarp | 400/605 X |
| 4,504,161 | 3/1985 | Volke et al. | 400/625 X |
| 4,568,211 | 2/1986 | Fox et al. | 400/690.4 X |
| 4,571,103 | 2/1986 | Takeo et al. | 400/616.1 X |
| 4,641,982 | 2/1987 | Rekewitz | 400/690.4 X |
| 4,662,767 | 5/1987 | Pimintel | 400/616.2 |
| 4,668,860 | 5/1987 | Okamura | 400/605 X |
| 4,682,804 | 7/1987 | Yoshimura et al. | 400/616.2 X |
| 4,742,946 | 5/1988 | Hamamichi et al. | 400/616.2 X |
| 4,747,710 | 5/1988 | Iwata et al. | 400/690.4 X |
| 4,787,545 | 11/1988 | Yasumi | 400/616.2 X |
| 4,802,280 | 2/1989 | Yokoi | 400/605 X |
| 4,806,036 | 2/1989 | Ward et al. | 400/605 |
| 4,822,192 | 4/1989 | Morita | 400/616.3 |
| 4,834,277 | 5/1989 | Gomoll et al. | 400/616 |
| 4,840,506 | 6/1989 | Kashiwagi | 400/690.4 |
| 4,981,380 | 1/1991 | Nishida et al. | 400/616.2 |

FOREIGN PATENT DOCUMENTS

| | | | |
|---|---|---|---|
| 205182 | 12/1982 | Japan | 400/616.2 |
| 150770 | 8/1984 | Japan | 400/616.2 |

OTHER PUBLICATIONS

Japanese Provisional Patent Publication No. 60-24985.

IBM Tech. Disc. Bulletin, "Power Driven, Hid-A--Way, Acoustic Hood", Freeman, vol. 20, No. 12, May 1978, pp. 5229-5230.

IBM Tech. Disc. Bulletin, "Acoustic Tractor", Meister, vol. 25, No. 7B, Oct. 1982, p. 3859.

*Primary Examiner*—Edgar S. Burr

*Assistant Examiner*—John S. Hilten

*Attorney, Agent, or Firm*—Lowe, Price, LeBlanc and Becker

[57] ABSTRACT

In a printer, a recording medium can be fed into and drawn out of a body through a rear opening formed in the body. A top cover assembly including a top cover and a shutter is angularly movable relatively to the body between an open position permitting access to an interior of the body and a closed position prohibiting access to the interior of the body. The recording medium can be fed into and drawn out of the body through an upper opening formed in the top cover. An inner surface of the shutter serving as a guide surface for the recording medium is exposed directly to the interior of the body when the top cover assembly is in the closed position. The shutter extends from a position adjacent the upper opening to a position adjacent the rear opening through a lower surface of a rear wall of the top cover. The shutter is movable relatively to the top cover between an open position opening the upper opening and a closed position closing the upper opening.

13 Claims, 11 Drawing Sheets

PRINTER HAVING A TOP COVER WITH AN ACCESS SHUTTER

BACKGROUND OF THE INVENTION

The present invention relates to a printer for printing information onto a recording medium and, more particularly, to an improved top cover assembly mounted to a body of the printer.

A printer is known, which serves as, for example, a peripheral instrument of a computer. The known printer has defined therein a plurality of predetermined transport paths for a recording medium such as a continuous form, cut-sheets or the like. A suitable one of the predetermined transport paths is selected in compliance with the types of the recording medium and feed modes thereof such as a normal feed mode, inch-cut feed mode and the like. Specifically, in case where information is printed onto the continuous form, the continuous form is fed into and drawn out of the printer body through a rear opening formed in the printer body. On the other hand, when an automatic cut-sheet feeder installed on the printer body is utilized to feed the cut-sheets one by one into the printer body, or when the cut-sheets are fed manually one by one into the printer body, the cut-sheets are fed into and drawn out of the printer body through an upper opening formed in a top cover mounted on the printer body.

The printer provided with the plurality of openings for the recording medium, in particular, an impact-type dot-matrix printer has the following problem. That is, in the impact-type dot-matrix printer, a plurality of electromagnetically actuated wires of a printing head strike the recording medium during printing, so that vibration due to the striking is propagated along the surface of the recording medium and is magnified. By this reason, if the opening for the recording medium, which is not utilized, is kept open, considerable noises resulting from the printing operation leak to the outside through the opening kept open.

Accordingly, it is desirable that the opening, which is not utilized at the present time, in particular, the upper opening located in the vicinity of the printing head or a platen and faced to an operator, is closed during the printing operation. Moreover, it is preferable that the opening degree of the upper opening is kept as small as possible even during the use of the upper opening.

Conventionally, a top cover assembly, in which an acoustic insulation shutter is combined with the top cover, has been utilized to cope with the above-discussed problem. That is, the shutter is mounted to the top cover for sliding movement therealong and relative thereto between a closed position where the shutter closes the upper opening formed in the top cover and an open position where the shutter opens the upper opening.

FIGS. 11*a* through 11*c* of the accompanying drawings diagrammatically show the conventional top cover assembly 100 composed of the top cover 101 and the shutter 103 described above. As shown in FIG. 11*a*, the shutter 103 is mounted to the top cover 101 for sliding movement therealong and relative thereto in a direction indicated by an arrow, between the closed position shown in the figures where the shutter 103 closes the upper opening 102 formed in the top cover 101 and the open position where the shutter 103 opens the upper opening 102. FIG. 11*a* shows a feed mode in which information is printed onto the continuous form 105 while the latter is fed around a platen 104 in a direction indicated by an arrow and, subsequently, the continuous form 105 is drawn out of the printer body through the rear opening 106. On the other hand, in case of a feed mode in which a cut sheet is fed into the body through the upper opening 102, is passed around the platen 104 and is discharged out of the body through the upper opening 102, the shutter 103 is slidingly moved to the open position to open the upper opening 102.

The top cover assembly 100 is mounted to the printer body for pivotal movement relative thereto about a pair of pivots 107 (only one shown) between a closed position shown in FIG. 11*a* and an open position shown in FIG. 11*b*. The top cover assembly 100 is moved angularly to the open position for the purpose of, for example, replacement of a print ribbon, and after a new print ribbon is loaded, the top cover assembly 100 is returned to the closed position to resume printing. In this connection, when the top cover assembly 100 is moved angularly from the closed position shown in FIG. 11*a* to the open position shown in FIG. 11*b*, the leading edge portion of the continuous form 105 may frequently come out of a feed passage 108 defined between the top cover 101 and the shutter 103. If the top cover assembly 100 is returned to the closed position with the leading edge portion of the continuous form 105 maintained out of the feed passage 108 as shown in FIG. 11*b*, there is such an anxiety that the leading edge portion of the continuous form 105 fed around the platen 104 is jammed within the printer body and is damaged.

SUMMARY OF THE INVENTION

It is an object of the invention to provide a printer capable of minimizing leaking of noises resulting from printing operation, to the outside of a printer body and capable of preventing jamming of a recording medium tending to occur due to angular movement of a top cover assembly relative to the printer body between an open position and a closed position.

According to the invention, there is provided a printer for printing information onto a recording medium, comprising:

a body formed therein with a rear opening through which the recording medium can be fed into and drawn out of the body; and a top cover assembly including a top cover and a shutter and mounted to the body for angular movement relative thereto between an open position permitting access to an interior of the body and a closed position prohibiting access to the interior of the body, the top cover having a top wall formed therein with an upper opening through which the recording medium can be fed into and drawn out of the body, the top cover further having a rear wall arranged above the rear opening in the body, the shutter having an inner surface exposed directly to the interior of the body when the top cover assembly is in the closed position so that the inner surface of the shutter serves as a guide surface for the recording medium, the shutter extending from a position adjacent the upper opening to a position adjacent the rear opening through a lower surface of the rear wall of the top cover, the shutter being mounted to the top cover for sliding movement relative thereto between an open position where the shutter opens the upper opening and a closed position where the shutter closes the upper opening.

DETAILED DESCRIPTION

Figure 1:
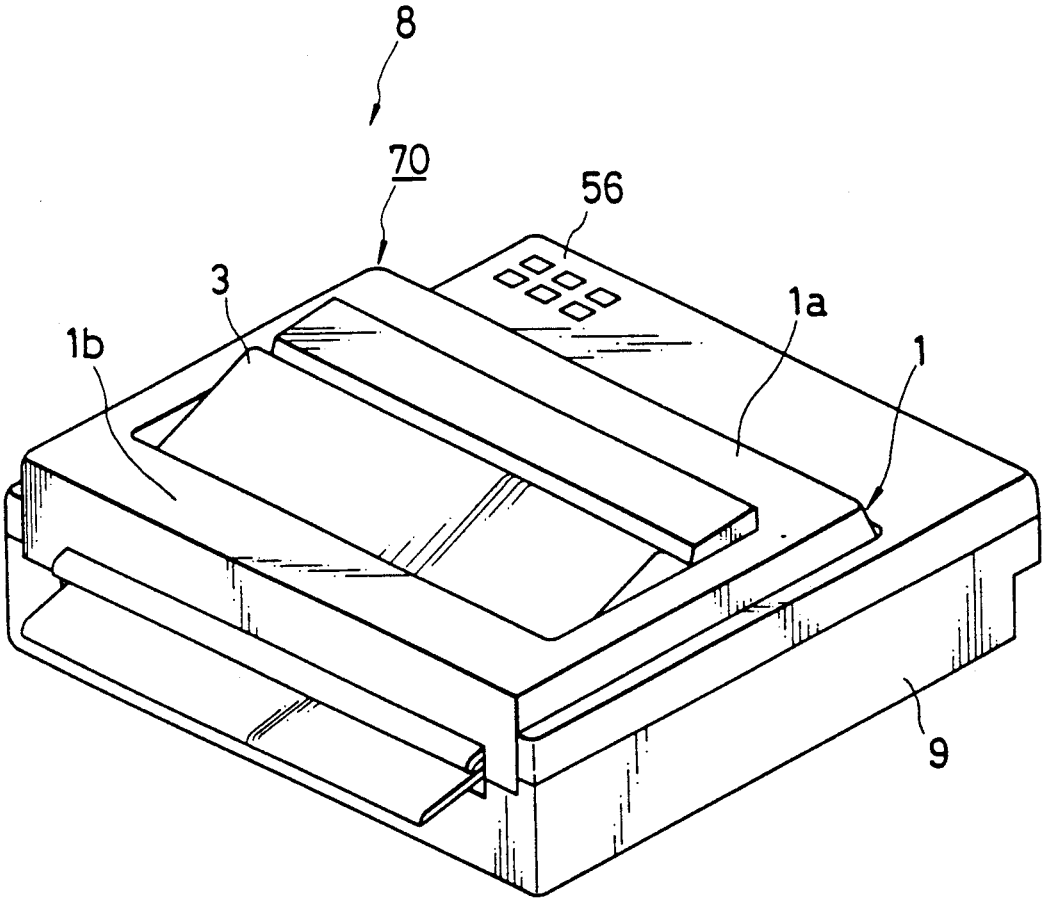
FIG. 1 is a perspective view of a printer according to an embodiment of the invention.

Referring first to FIG. 1, there is shown an impact-type dot-matrix printer 8 according to an embodiment of the invention. The printer 8 comprises a body 9, and a top cover assembly 70 mounted to the body 9. The top cover assembly 70 is composed of a top cover 1 and an acoustic insulation shutter 3. Function keys 56 are arranged on a front upper portion of the body 9, for setting printing modes, feed modes of a recording medium such as a continuous form 5*a* (see, for example, FIG. 4) and cut-sheets 5*b* (see, for example, FIG. 8), and the like. The top cover assembly 70 is mounted to the body 9 for pivotal movement relative thereto about a pair of pivots 7 (see, FIGS. 2, 3*b* and 3*c*, but only one shown) attached to a rear portion of the body 9, between an open position permitting access to an interior of the body 9 for the purpose of, for example, replacement of a print ribbon and a closed position shown in FIG. 1, prohibiting access to the interior of the body 9.

Figure 2:
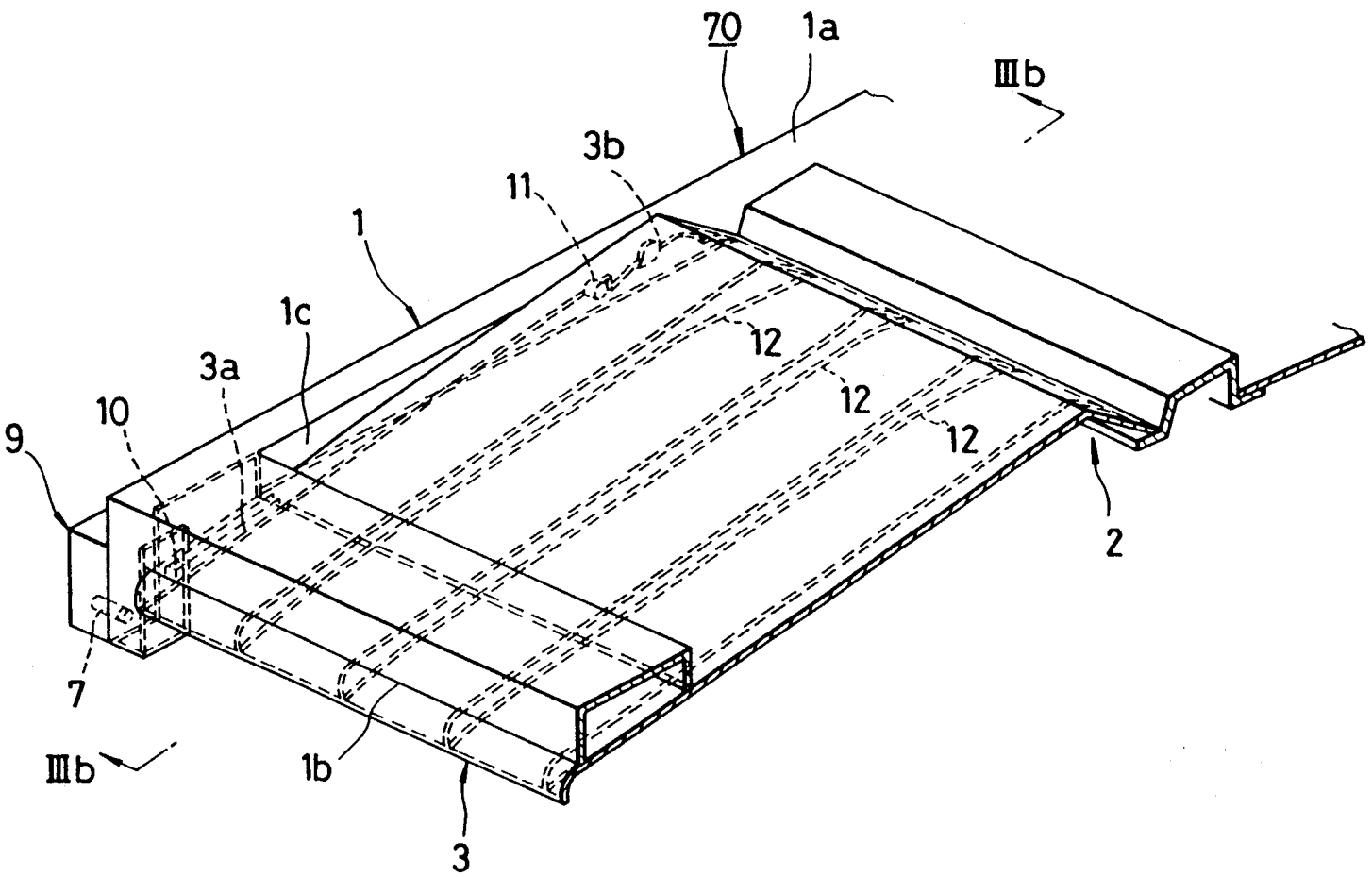
FIG. 2 is a partially cross-sectional fragmentary perspective view of a top cover assembly mounted to a body of the printer illustrated in FIG. 1.
Figure 3A:
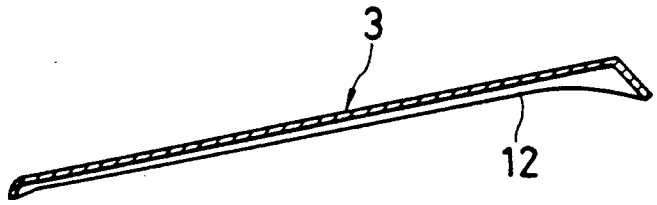
FIG. 3*a* is a cross-sectional view of a shutter of the top cover assembly illustrated in FIG. 2.
Figure 4:
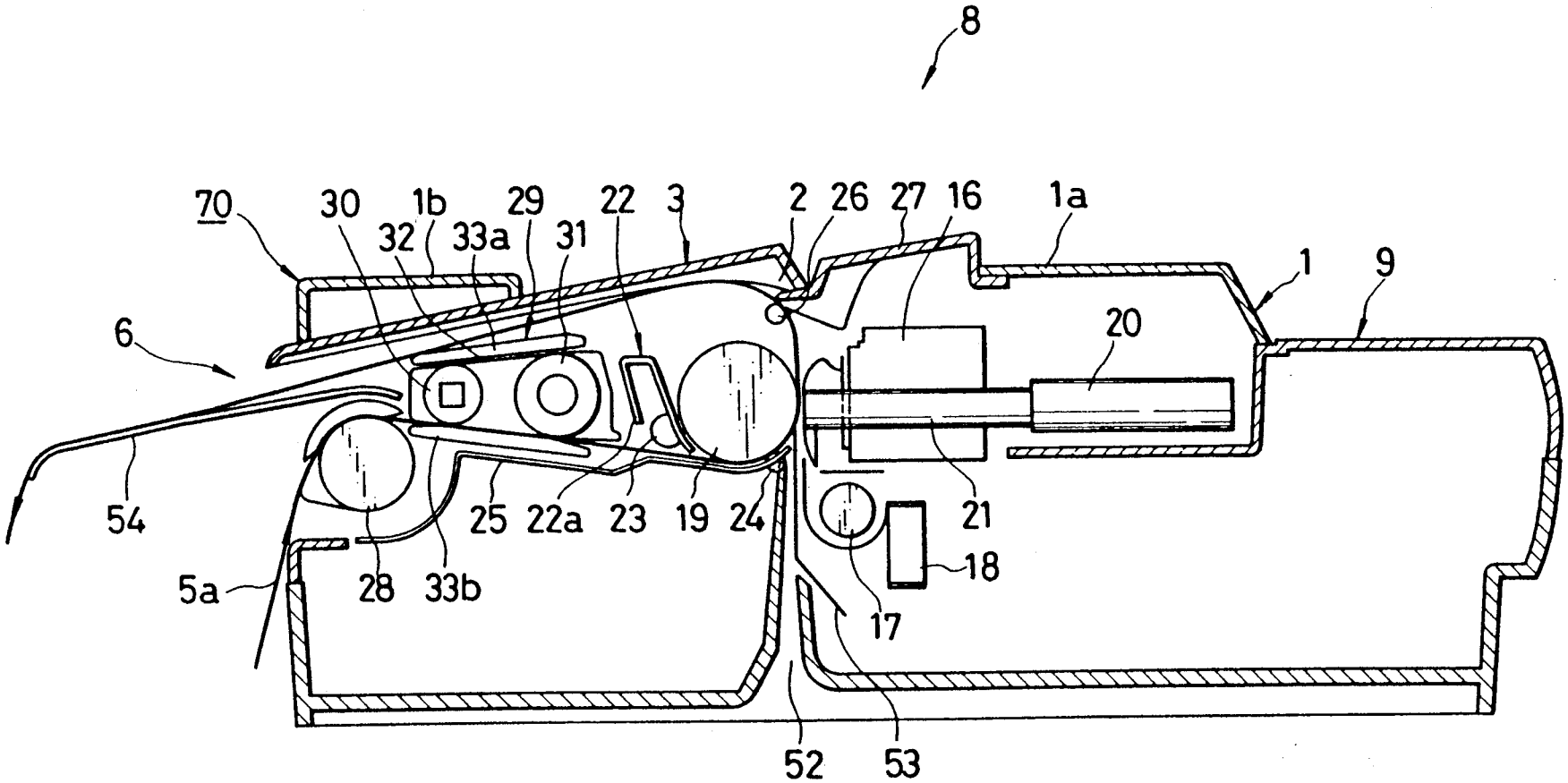
FIG. 4 is a cross-sectional view of the printer illustrated in FIG. 1, showing a feed mode in which a continuous form is fed into and drawn out of the body through a rear opening.

As shown in FIG. 4, the body 9 is formed therein with a rear opening 6 through which the continuous form 5*a* can be fed into and drawn out of the interior of the body 9. On the other hand, the top cover 1 of the top cover assembly 70 has a top wall 1*a* formed therein with an upper opening 2 through which the recording medium can be fed into and drawn out of the interior of the body 9. The top cover 1 further has a rear wall 1*b* located above the rear opening 6. The shutter 3 extends from a position adjacent the upper opening 2 to a position adjacent the rear opening 6 through a lower surface of the rear wall 1*b* of the top cover 1. In this manner, when the top cover assembly 70 is in the closed position shown in FIG. 4, an inner surface of the shutter 3 is exposed directly to the interior of the body 9 so that the inner surface serves as a guide surface for the continuous form 5*a*. The guide surface is provided with a plurality of spaced guide ribs 12 which extend parallel to a direction in which the continuous form 5*a* is fed during printing, as shown in FIGS. 2 and 3*a*. The shutter 3 is mounted to the top cover 1 in such an inclined manner that a forward end of the shutter 3 adjacent the upper opening 2 is located above a rearward end of the shutter 3 adjacent the rear opening 6. Such inclined mounting of the shutter 3 to the top cover 1 makes it possible to lower the vertical position of the rear wall 1*b* of the top cover 1. It is needless to say, however, that the shutter 3 can be mounted to the top cover 1 so as to extend horizontally.

Figure 3B:
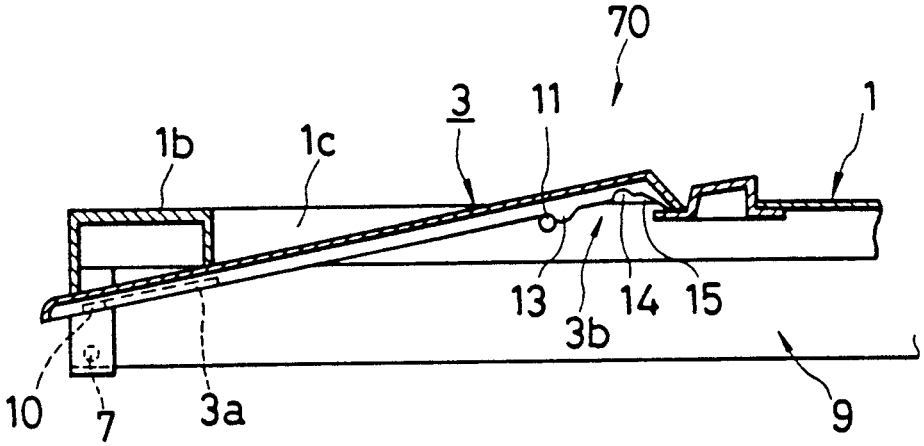
FIG. 3*b* is a fragmentary cross-sectional view taken along the line IIIb—IIIb in FIG. 2.
Figure 3C:
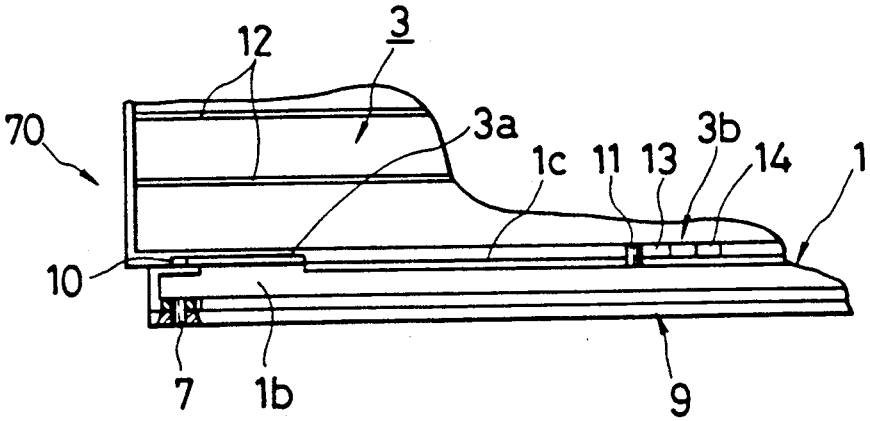
FIG. 3*c* is a fragmentary bottom view of the top cover assembly illustrated in FIG. 3*b;*
Figure 7:
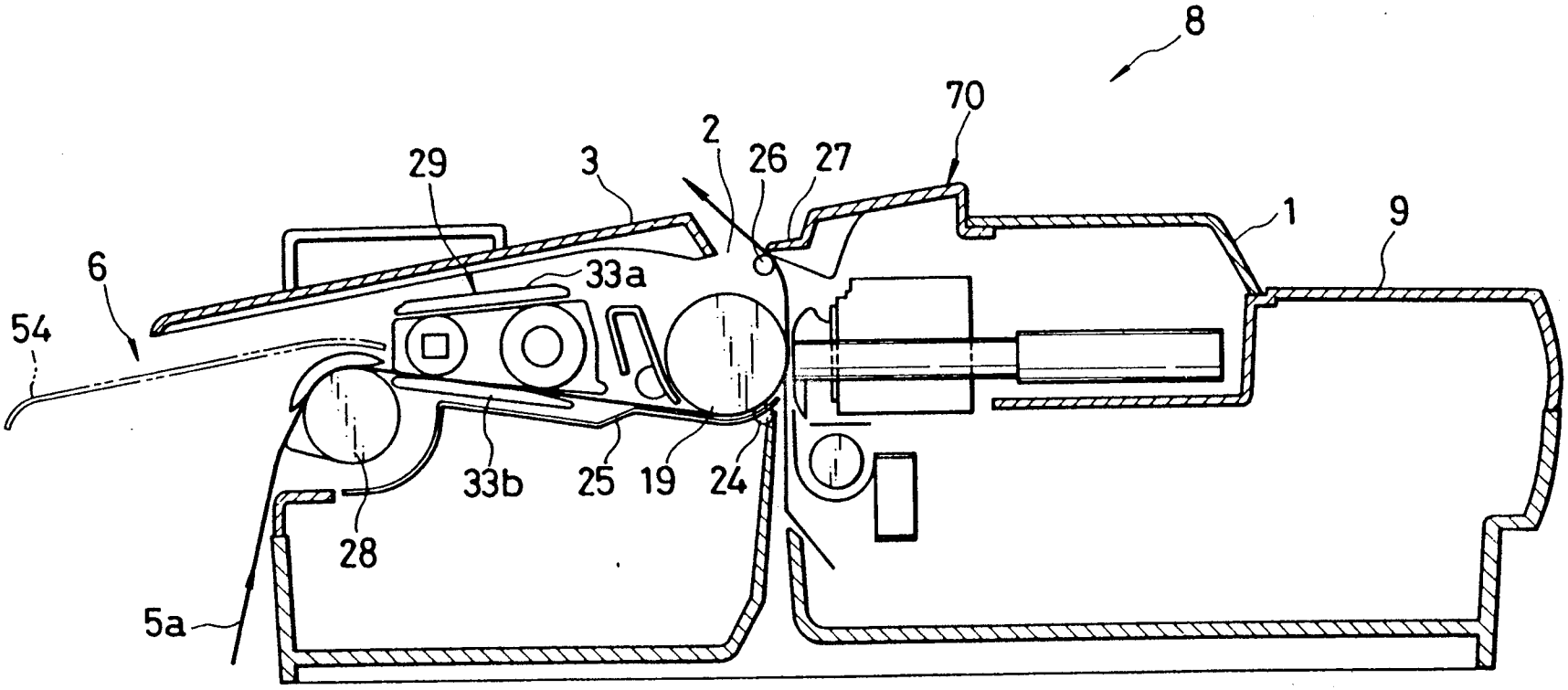
FIG. 7 is a view similar to FIG. 4, but showing a feed mode in which the continuous form is fed into the body through the rear opening and is drawn out of the body through an upper opening.
Figure 8:
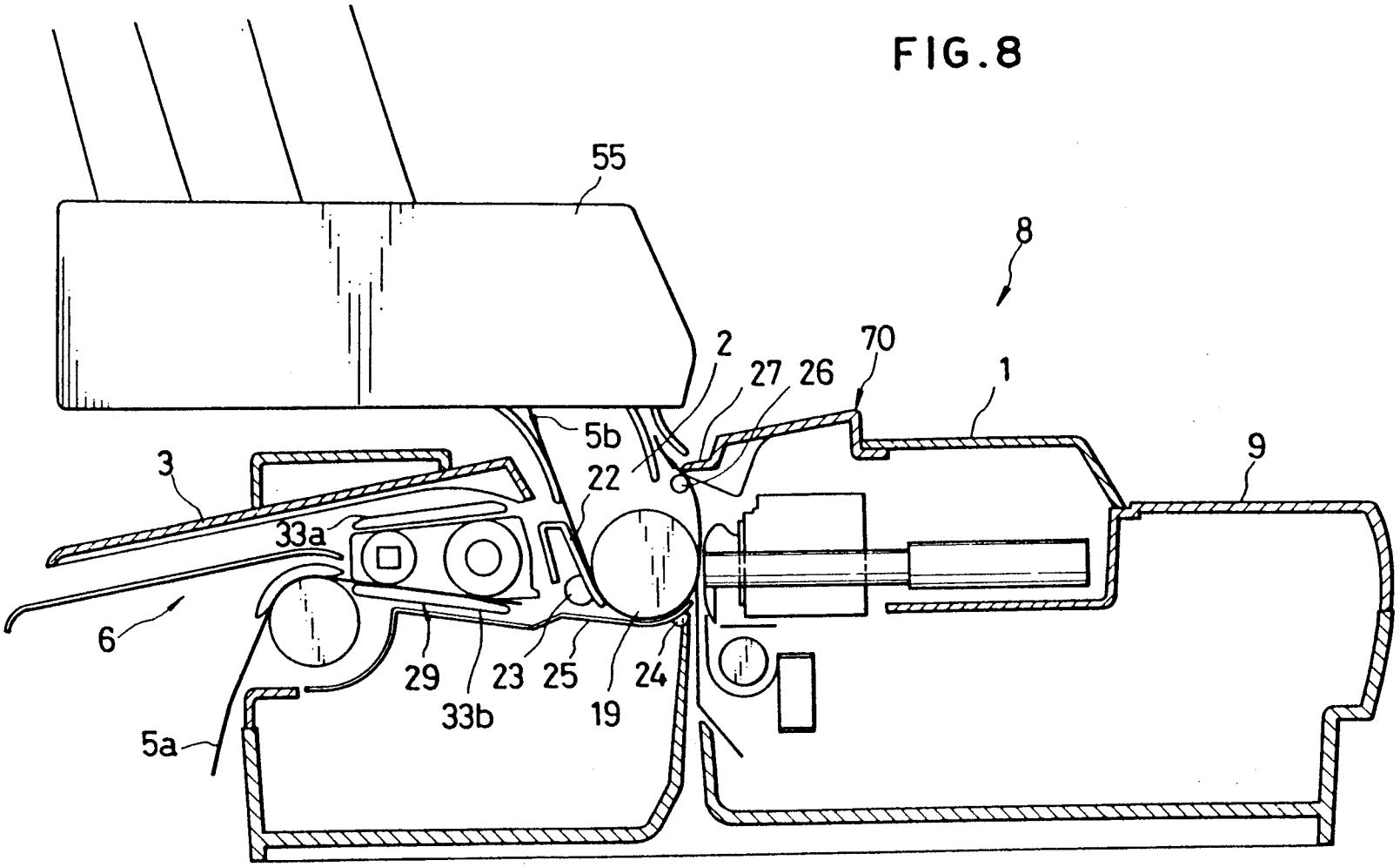
FIG. 8 is a view similar to FIG. 4, but showing a feed mode in which cut sheets are fed by means of an automatic cut-sheet feeder.
Figure 9:
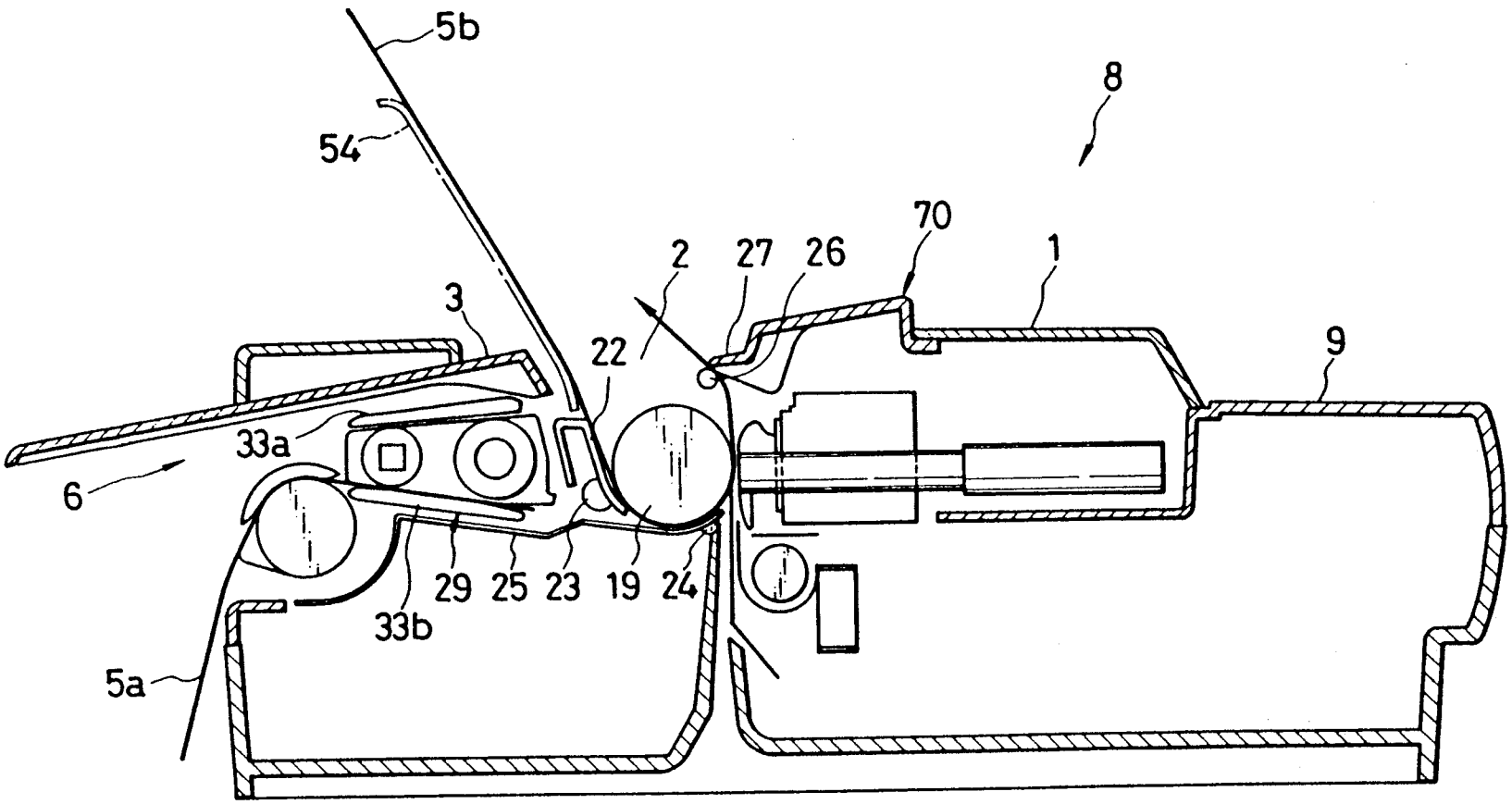
FIG. 9 is a view similar to FIG. 4, but showing a feed mode in which the cut sheets are fed manually.

The shutter 3 is mounted to the top cover 1 for sliding movement relative thereto between an open position where the shutter 3 opens the upper opening 2 and a closed position where the shutter 3 closes the upper opening 2. Specifically, as shown in FIGS. 2, 3*b* and 3*c*, an elongated groove 3*a* having a predetermined length is formed in an outer surface of the rearward portion of each of the opposite sides of the shutter 3. On the other hand, a projection 10 having a rectangular cross-sectional shape is provided on an inward sliding surface 1*c* of each of the opposite side walls of the top cover 1. The projection 10 is fitted in the elongated groove 3*a* for sliding movement relatively therealong. Further, a forward portion of each side of the shutter 3 is formed into an engaging portion 3*b* engageable with a columnar projection 11 provided on each of the sliding surfaces 1*a* of the top cover 1. As shown in detail in FIGS. 3*b* and 3*c*, the engaging portion 3*b* is composed of three engaging sections which include a first engaging section 13 formed by a projection, a second engaging section 14 formed by a semi-circular recess, and a third engaging section 15 formed by a downwardly bent forward end portion of the shutter 3. When the shutter 3 is slidingly moved relatively to the top cover 1 to bring the first engaging section 13 into engagement with the columnar projection 11 on the top cover 1, the shutter 3 occupies the fully closed position as shown in FIG. 4, thereby fully closing the upper opening 2. When the second engaging section 14 is engaged with the columnar projection 11, the shutter 3 occupies an intermediate open position as shown in FIG. 7, to slightly open the upper opening 2. When the third engaging section 15 is engaged with the columnar projection 11, the shutter 3 occupies the fully open position as shown in FIGS. 8 and 9, to fully open the upper opening 2. Thus, the shutter 3 is mounted to the top cover 1 for sliding movement relative thereto within an extent of the elongated groove 3*a* so as to enable the opening degree of the upper opening 2 to be adjusted in a stepped manner.

A printing mechanism of the dot-matrix printer 8 will briefly be described with reference to FIG. 4. A carriage 16 is mounted on a carriage guide 17 fixed to the body 9 of the printer, for movement along the carriage guide 17. The carriage 16 is reciprocatively moved along the carriage guide 17 by a motor (not shown) through a timing belt 18. A printing head (not shown) is fixedly mounted to the carriage 16 so as to face toward a platen 19 which is rotatably supported by the body 9. The printing head cooperates with the platen 19 to define therebetween a printing position where information is printed onto the recording medium. A ribbon supply unit 20 feeds an unused portion of a print ribbon 21 to the printing position, and collects a used portion of the print ribbon 21.

A feed mechanism for feeding the recording medium will next be described briefly with reference to FIG. 4. A first guide plate 22 is provided which guides, toward the platen 19, the recording medium such as cut-sheets or the like inserted into the body 9 through the upper opening 2. The first guide plate 22 has its base portion 22*a* which is fixed to the body 9. A friction roller 23 is rotatably supported by the body 9 at a location adjacent a lower portion of the first guide plate 22. Further, the friction roller 23 is abutted against the platen 19 under biasing force of resilient or elastic elements interposed between the friction roller 23 and the body 9. A friction roller 24 is rotatably supported by the body 9 at a forward end of a second guide plate 25, and is in pressure contact with the platen 19. A feed roller 26 rotatably supported by the body 9 is arranged along a rearward edge of a paper follower 27 which forms a part of the top wall 1*a* of the top cover 1. The feed roller 26 is so designed as to lightly feed the recording medium in synchronism with rotation of the platen 19.

A loading roller 28 is arranged adjacent the rear opening 6, for automatically loading the continuous form 5*a* to a pair of tractors 29 (only one shown) which are spaced from each other along the platen 19. The body 9 has its bottom formed therein with a lower insertion opening 52 through which the continuous form 5*a* can be fed into the body 9. A third guide plate 53 serves to guide the continuous form 5*a* fed into the body 9 through the lower insertion opening 52. The continuous form 5*a* drawn out of the body 9 through the rear opening 6 is received by a tray 54 arranged at the rear opening 6.

When the continuous form 5*a* is employed, the above-mentioned pair of tractors 29 feed the continuous form 5*a* to the printing position. Each tractor 29 comprises a drive roller 30, a driven roller 31, and a timing belt 32 which runs between and around these rollers 30 and 31. The timing belt 32 is provided with a plurality of projections engageable with sprocket holes formed in a corresponding one of the opposite side edges of the continuous form 5*a*. An upper retainer 33*a* associated with an upper run of the timing belt 32 is movable angularly between a closed position where the upper retainer 33*a* cooperates with the upper run to retain therebetween the continuous form 5*a*, and an open position where the continuous form 5*a* is disengageable from the upper run. A lower retainer 33*b* is associated with a lower run of the timing belt 32 in a manner similar to the upper retainer 33*a*.

A drive mechanism for the tractor 29 and the platen 19 will be described with reference to FIGS. 10*a* and 10*b*. A gear 35 is mounted on a drive shaft 34 of the platen 19 for rotation therewith. Fixedly mounted to a free end of the drive shaft 34 is a manual operating knob 51 for rotating the platen 19 manually. The gear 35 is in mesh with a gear 38 mounted on a rotary shaft 37 for rotation therewith, which is supported rotatably by a side frame 36 of the body 9. A gear 39 is mounted on the rotary shaft 37 for rotation therewith. The gear 39 is in mesh with a gear 41 mounted on a rotary shaft 40 for rotation therewith, which is supported rotatably by the side frame 36. A gear 42 is mounted on the rotary shaft 40 for rotation therewith. The gear 42 is in mesh with a pinion gear 44 which is fixedly mounted on an output shaft 43 of a drive motor M. On the other hand, a gear 46 is mounted on a drive shaft 45 for the drive roller 30 of the tractor 29, for rotation with the drive shaft 45. The gear 46 is drivingly connectable to the aforesaid gear 41 through a gear 48 mounted on a shaft 47 for rotation relative thereto, which is fixedly supported by the side frame 36.

Figure 10A:
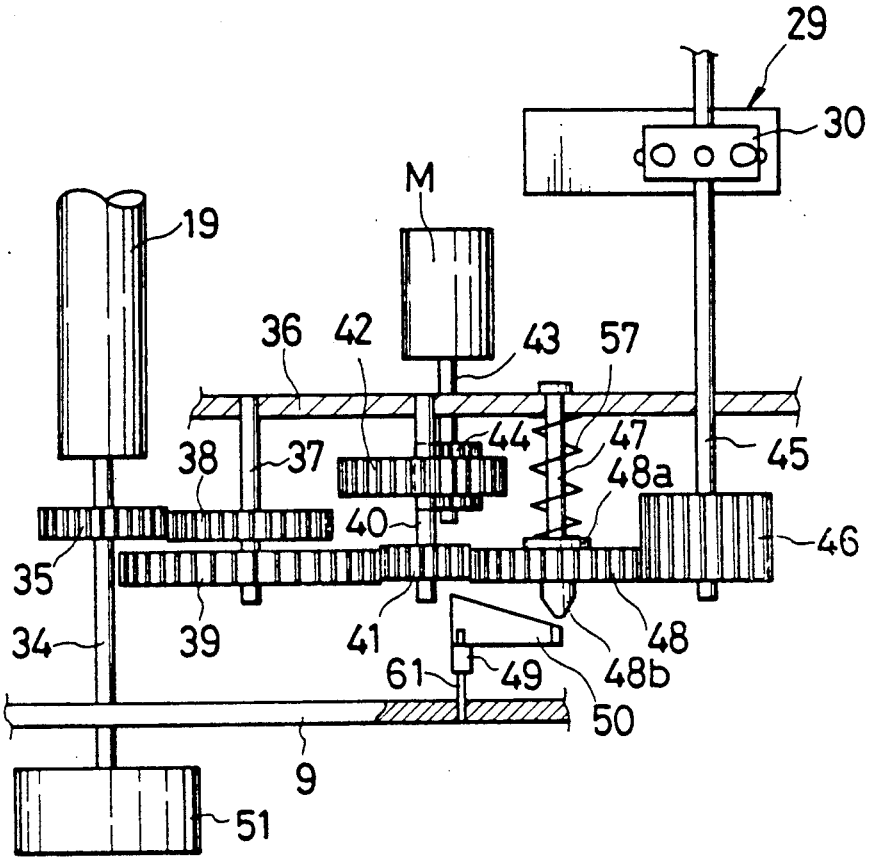
FIG. 10*a* is a partially cross-sectional fragmentary plan view of a drive mechanism incorporated in the printer illustrated in FIGS. 1 through 9.
Figure 10B:
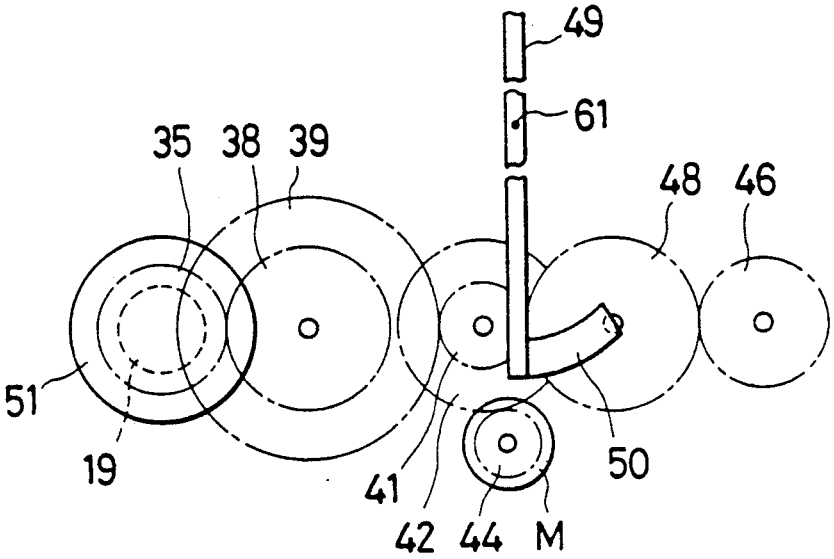
FIG. 10*b* is a side elevational view of the drive mechanism illustrated in FIG. 10*a*.
Figure 11A:
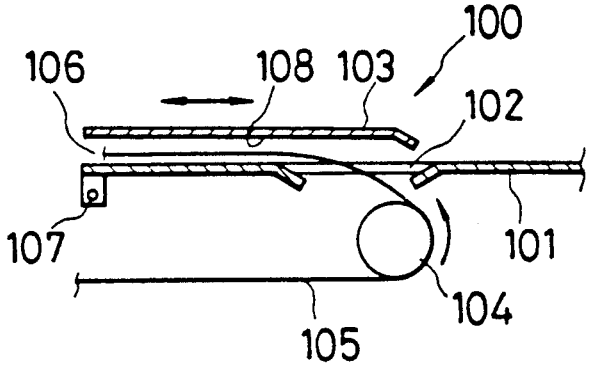
FIGS. 11*a* through 11*c* are diagrammatic fragmentary cross-sectional views of a top cover assembly of a conventional printer.
Figure 11B:
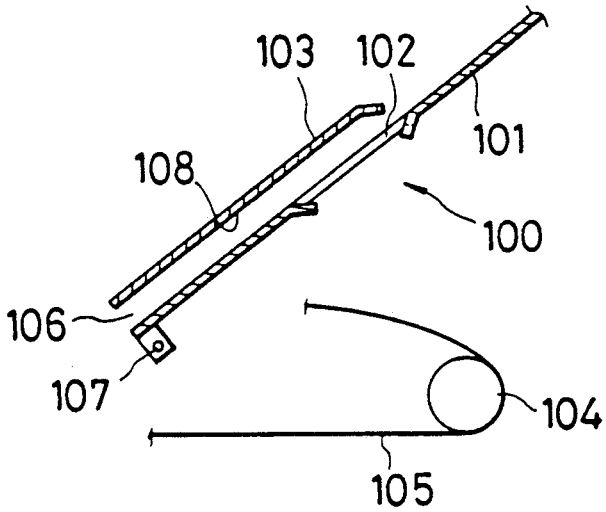
Figure 11C:
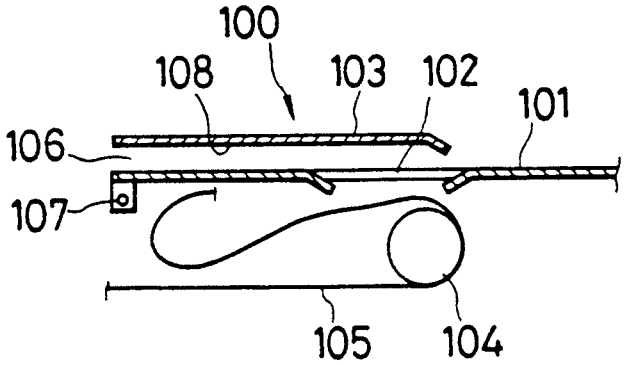

The gear 48 is always in mesh with the gear 46, but is mounted on the shaft 47 for movement therealong between an operative position shown in FIG. 10*a* where the gear 48 is in mesh with the gear 41 and an inoperative position between the gears 41 and 42 where the gear 48 is out of mesh with the gear 41. The gear 48 is normally in the operative position under biasing force of a coil spring 57 which is arranged about the shaft 47 and between the side frame 36 and a flange 48*a* under compression. A switching lever 49, which is supported by a pivot 61 attached to the body 9 for pivotal movement about the pivot 61, is provided with a cam 50 engageable with a head 48*b* of the gear 48. The arrangement is such that the switching lever 49 can be moved angularly about the pivot 61 to cause the cam 50 to move the gear 48 to the inoperative position against the biasing force of the coil spring 57. Specifically, when the switching lever 49 is in a position shown in FIG. 10*b*, the cam 50 is maintained disengaged from the head 48*b* so that the gear 48 is moved to the operative position under the biasing force of the spring 57. On the other hand, when the switching lever 49 is moved angularly about the pivot 61 in the counterclockwise direction as viewed in FIG. 10*b*, the cam 50 is brought into engagement with the head 48*b* to move the gear 48 to the inoperative position against the biasing force of the spring 57.

The operation of the printer constructed as above will be described below.

FIG. 4 shows a usual or normal feed mode in which the continuous form 5*a* is fed along a predetermined transport path extending from and to the rear opening 6 through the printing position between the platen 19 and the printing head mounted to the carriage 16. In the normal feed mode, the continuous form 5*a* automatically loaded by the loading roller 28 through the rear opening 6 is engaged with the tractor 29 and is retained by the lower retainer 33*b*. When the tractor 29 is driven together with the platen 19 by the drive motor M (see FIG. 10*a*), the continuous form 5*a* is guided along the guide plate 25 and is wrapped around the platen 19. The printing head mounted to the carriage 16 prints information onto the continuous form 5*a* on the platen 19. Subsequently, the continuous form 5*a* is clamped between the feed roller 26 and the paper follower 27 and is lightly pulled up by them. Then, the continuous form 5*a* is guided along the ribs 12 formed on the inner surface of the shutter 3, and is drawn out of the body 9 through the rear opening 6.

Figure 5:
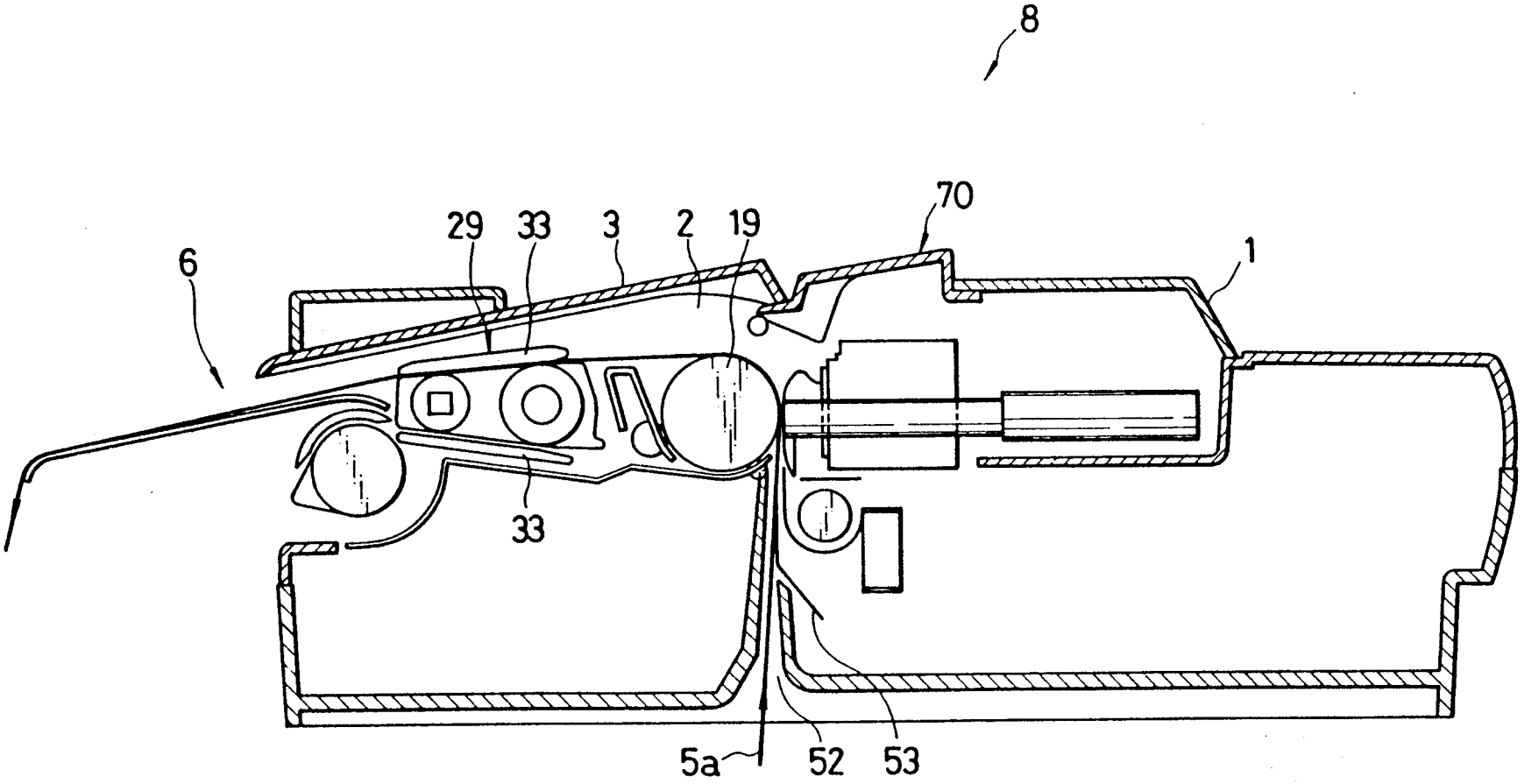
FIG. 5 is a view similar to FIG. 4, but showing a feed mode in which the continuous form is fed into the body through a lower insertion opening and is discharged out of the body through the rear opening.

FIG. 5 shows a feed mode in which the continuous form 5*a* is fed along a predetermined transport path extending from the lower insertion opening 52 to the rear opening 6 through the printing position. In the feed mode illustrated in FIG. 5, the continuous form 5*a* inserted into the body 9 through the lower insertion opening 52 is guided toward the platen 19 along a guide plate 53. Information is printed onto the continuous form 5*a* on the platen 19 and, subsequently, is drawn out of the body 9 through the rear opening 6 by the tractor 29 driven together with the platen 19. In case of the feed mode shown in FIG. 5, the continuous form 5*a* is retained in engagement with the tractor 29 by the upper retainer 33*a*.

Figure 6:
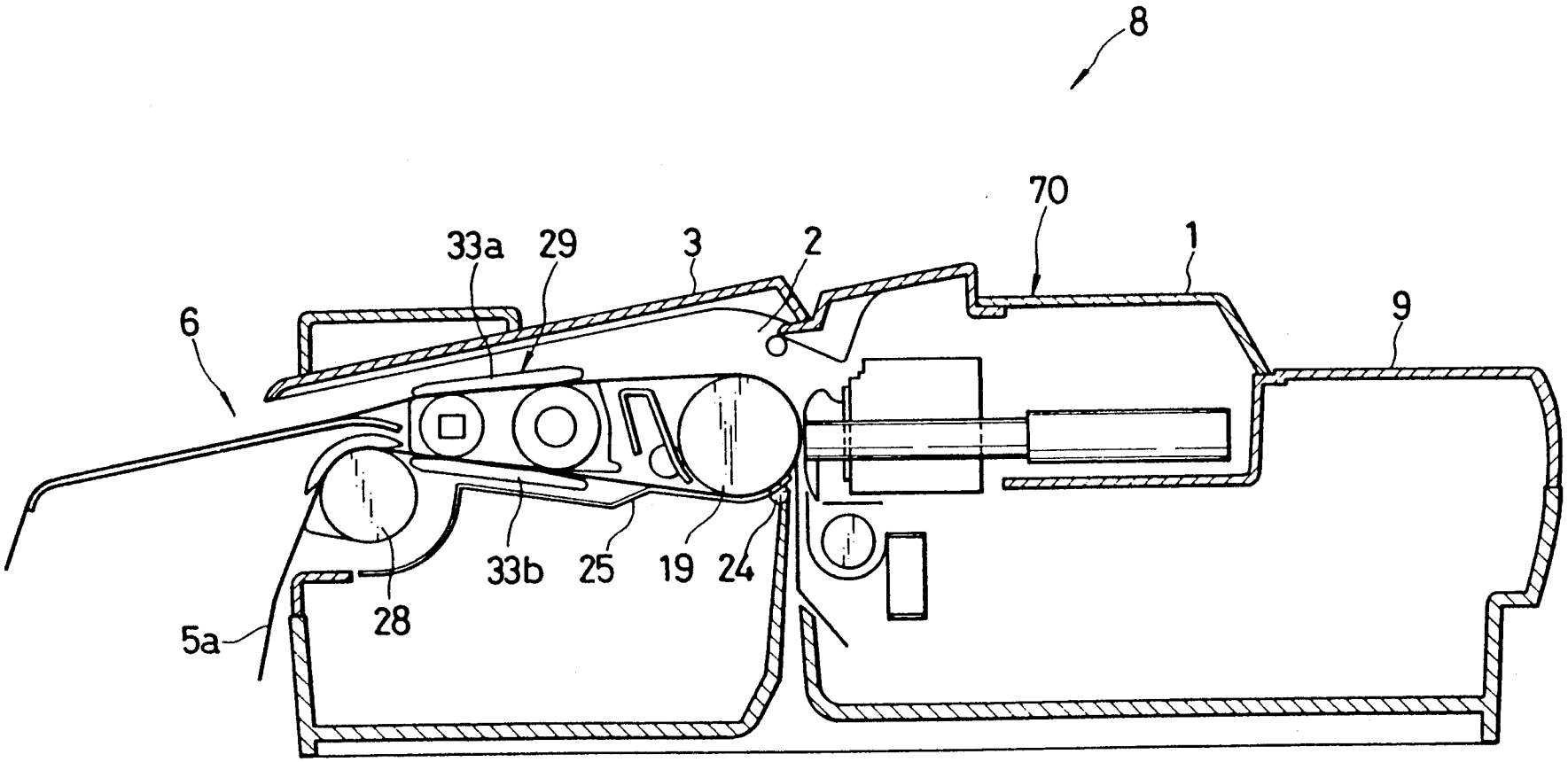
FIG. 6 is a view similar to FIG. 4, but showing the continuous form fed in a bi-directional feed mode.

FIG. 6 shows a bi-directional feed mode in which the continuous form 5*a* is fed along a predetermined transport path extending from and to the rear opening 6 through the printing position. In the feed mode illustrated in FIG. 6, the continuous form 5 automatically loaded by the loading roller 28 through the rear opening 6 is retained in engagement with the tractor 29 by the lower retainer 33*b*. Information is printed onto the continuous form 5*a* on the platen 19. Subsequently, the continuous form 5*a* is retained in engagement with the tractor 29 by the upper retainer 33*a*, and is discharged out of the body 9 through the rear opening 6. In case of the feed mode shown in FIG. 6, the rotational direction of the drive motor M shown in FIG. 10*a* is so switched as to feed the continuous form 5*a* bi-directionally.

It is unnecessary for the feed modes shown respectively in FIGS. 4 through 6 to employ the upper opening 2. Accordingly, the shutter 3 fully closes the upper opening 2 in such a manner that the first engaging section 13 of the shutter 3 is engaged with the columnar projection 11 on the top cover 1, as shown in FIG. 3*b*.

In connection with the above, even if the top cover assembly 70 is moved to the open position in case of each of the feed modes shown respectively in FIGS. 4 through 6, the top cover 1 and the shutter 3 of the top cover assembly 70 do not wholly interfere with the transport path for the continuous form 5*a*.

FIG. 7 shows an inch-cut feed mode in which the continuous form 5*a* is fed along a predetermined transport path extending from the rear opening 6 to the upper opening 2 through the printing position. In the inch-cut feed mode, the continuous form 5*a* automatically loaded by the loading roller 28 through the rear opening 6 is retained by the lower retainer 33*b* and is engaged with the tractor 29. The continuous form 5*a* is fed toward the platen 19 by the tractor 29 while being guided by the second guide plate 25. Information is printed onto the continuous form 5*a* on the platen 19 and, subsequently, the continuous form 5*a* is clamped between the feed roller 26 and the paper follower 27 and is lightly pulled up by them. The continuous form 5*a* having passed through the nip between the feed roller 26 and the paper follower 27 is drawn out of the body 9 through the upper opening 2.

In case of the feed mode shown in FIG. 7, the second engaging section 14 of the shutter 3 shown in FIG. 3*b* is engaged with the columnar projection 11 on the top cover 1 so that the shutter 3 is in the intermediate open position where the upper opening 2 is opened with a requisite minimum opening degree. The tray 54 is not required for the feed mode shown in FIG. 7 and, accordingly, may be removed from the body 9.

FIGS. 8 and 9 show respectively feed modes which are different from each other, but which are common to each other in that the cut sheets 5*b* are fed along a predetermined transport path extending from and to the upper opening 2 through the printing position. Specifically, in the feed mode illustrated in FIG. 8, the automatic cut-sheet feeder 55 is employed to feed the cut sheets 5*b*. On the other hand, in the feed mode illustrated in FIG. 9, the tray 54 is mounted to the top cover 1 and the cut sheets 5*b* are fed manually.

In each of the feed modes shown respectively in FIGS. 8 and 9, the cut sheet 5*b* fed by the automatic cut-sheet feeder 55 or fed manually through the upper opening 2 is guided along the first guide plate 22 to the nip between the friction roller 23 and the platen 19. When the platen 19 is rotatively driven, the cut sheet 5*b* is fed along the guide plate 25, and is passed through the nip between the friction roller 24 and the platen 19. Information is printed onto the cut sheet 5*b* on the platen 19 and, subsequently, the leading edge portion of the cut sheet 5*b* reaches the nip between the feed roller 26 and the paper follower 27. The cut sheet 5*b* is lightly pulled up by the feed roller 26 rotatively driven in synchronism with the platen 19, and is drawn out of the body 9 through the upper opening 2.

In the feed modes shown respectively in FIGS. 8 and 9, the shutter 3 is in the fully open position, because the cut sheet 5*b* is fed into and drawn out of the body 9 through the upper opening 2. That is, the third engaging section 15 of the shutter 3 shown in FIG. 3*b* is engaged with the columnar projection 11 on the top cover 1, so that the shutter 3 fully opens the upper opening 2.

It is often desired to effect printing by the use of the cut sheets 5*b* in succession of printing by the use of the continuous form 5*a*. In this case, the function keys 56 shown in FIG. 1 are manipulated to suspend the printing operation with respect to the continuous form 5*a*. Subsequently, the drive motor M shown in FIG. 10*a* is rotated in the reverse direction, to rotate the platen 19 as well as the tractor 29 in the direction reverse to that at the normal feed mode, thereby returning the leading edge portion of the continuous form 5*a* to a position where the leading edge is in engagement with the tractor 29, but is disengaged from the platen 19. A sensor (not shown) arranged within the body 9 detects automatically whether or not the leading edge portion of the continuous form 5*a* is disengaged from the platen 19. The drive motor M is stopped in response to a signal from the sensor which indicates that the leading edge portion of the continuous form 5*a* is disengaged from the platen 19. Then, the switching lever 49 shown in FIGS. 10*a* and 10*b* is operated to move the gear 48 to the inoperative position so that the gear 48 is disengaged from the gear 41, thereby preventing the power of the drive motor M from being transmitted to the tractor 29. At the same time, the friction rollers 23 and 24 are moved from their respective normal positions spaced away from the circumferential surface of the platen 19, and are brought into pressure contact with the platen 19. Thus, it is prevented that the continuous form 5*a* is fed by the tractor 29 during printing of information onto the cut sheets 5*b*. If it is desired to resume printing by the use of the continuous form 5*a* after the printing of the information onto the cut sheets 5*b*, the automatic cut-sheet feeder 55 is removed from the body 9, or the tray 54 is removed from the top cover 1 and, subsequently, the shutter 3 is moved to the fully closed position. The switching lever 49 shown in FIGS. 10*a* and 10*b* is then operated to move the gear 48 to the operative position to bring the gear 48 into engagement with the gear 41, thereby permitting the power of the drive motor M to be transmitted to the tractor 29. Subsequently, the function keys 56 are manipulated to resume printing with respect to the continuous form 5*a*.

In the illustrated embodiment, it has been described that the engaging portion 3*b* is provided on the shutter 3, while the columnar projection 11 is provided on the top cover 1. It will be understood by one skilled in the art, however, the arrangement may be such that the engaging portion 3b is provided on the top cover 1, while the columnar projection 11 is provided on the shutter 3. Likewise, the arrangement may be such that the elongated groove 3a is provided in the top cover 1, while the projection 10 fitted in the elongated groove 3a is provided on the shutter 3.

As described above, the arrangement of the printer according to the invention is such that the shutter 3 can selectively be moved between the closed position and the open position in compliance with the types of the recording medium to be employed and the various feed modes of the recording medium, and that the shutter 3 can be retained at the closed position except for case of necessity. With such arrangement, it is possible to minimize the noises leaking from the interior of the printer body 9 to the outside through the upper opening 2 during the printing operation.

Furthermore, the inner surface of the shutter 3 is exposed directly to the interior of the body 9 when the top cover assembly 70 is in the closed position. Accordingly, even if the top cover assembly 70 is once moved to the open position and is thereafter returned to the closed position, it can be ensured that the leading edge portion of the recording medium is brought into contact with the inner surface of the shutter 3. Thus, the recording medium can be guided toward the rear opening 6 at the subsequent printing operation, without any trouble or difficulty, thereby making it possible to minimize the possibility of occurrence of jamming of the recording medium.

Moreover, the arrangement of the embodiment described above is such that a selected one of the three engaging sections 13, 14 and 15 of the engaging portion 3b provided on the shutter 3 is engaged with the columnar projection 11 on the top cover 1, whereby the shutter 3 is positioned with respect to the top cover 1 reliably. With such arrangement, it is possible to prevent the shutter 3 from being moved relatively to the top cover 1 due to vibration during the printing operation. It is also possible to simply select the position of the shutter 3 relative to the top cover 1 in a stepped manner.

What is claimed is:

1. A printer for printing information onto a recording medium, comprising:

a body formed therein with a rear opening through which said recording medium can be fed into and drawn out of said body; and a top cover assembly including a top cover and a shutter and mounted to said body for angular movement relative thereto between an open position permitting access to an interior of said body and a closed position prohibiting access to the interior of said body, said top cover having a top wall formed therein with an upper opening through which said recording medium can be fed into and drawn out of said body, said top cover further having a rear wall arranged above said rear opening in said body, said shutter having an inner surface exposed directly to the interior of said body when said top cover assembly is in said closed position so that said inner surface of said shutter serves as a guide surface for said recording medium, said shutter extending from a position adjacent said upper opening to a position adjacent said rear opening through a lower surface of said rear wall of said top cover, said shutter being mounted to said top cover for sliding movement relative thereto between an open position where said shutter opens said upper opening and a closed position where said shutter closes said upper opening, said shutter being arranged to be held at an intermediate position between said open position and said closed position.

2. A printer according to claim 1, wherein said shutter is movable relatively to said top cover so that an opening degree of said upper opening can be adjusted in a stepped manner.

3. A printer according to claim 2, wherein one of said top cover and said shutter is provided with projection means, while the other is provided with a plurality of engaging means, wherein when one of said plurality of engaging means is engaged with said projection means, said shutter occupies its closed position, and wherein when the remaining plurality of engaging means are engaged with said projection means, said shutter opens said upper opening with opening degrees corresponding respectively to the remaining plurality of engaging means.

4. A printer according to claim 1, wherein one of said top cover and said shutter is provided with elongated groove means, while the other is provided with projection means fitted in said elongated groove means, and wherein said shutter is slidingly movable relatively to said top cover within an extent of said elongated groove means.

5. A printer according to claim 1, wherein said shutter is mounted to said top cover in such an inclined manner that a forward end of said shutter adjacent said upper opening is located above a rearward end of said shutter adjacent said rear opening.

6. A printer according to claim 1, wherein said inner surface of said shutter is provided with a plurality of ribs extending in a direction in which said recording medium is fed.

7. A printer according to claim 1, wherein said shutter is movable relatively to said top cover selectively among a fully closed position fully closing said upper opening, an intermediate open position opening said upper opening with a first opening degree, and a fully open position opening said upper opening with a second opening degree larger than said first opening degree.

8. A printer according to claim 7, further comprising means for defining a plurality of predetermined transport paths for said recording medium, and means for feeding said recording medium along a selected one of said plurality of predetermined transport paths, wherein said shutter is moved to one of said fully closed position, said intermediate open position and said fully open position in compliance with said selected transport path.

9. A printer according to claim 8, wherein said body has defined therewithin a printing position where the information is printed onto said recording medium, and wherein said plurality of predetermined transport paths include a first transport path extending from and to said rear opening through said printing position, a second transport path extending from said rear opening to said upper opening through said printing position, and a third transport path extending from and to said upper opening through said printing position.

10. A printer according to claim 9, wherein said body is further formed therein with a lower insertion opening through which said recording medium can be inserted into said body, and wherein said predetermined transport paths further include a fourth transport path extending from said lower insertion opening to said rear opening through said printing position.

11. A printer according to claim 10, wherein when said recording medium is fed along a selected one of said first and fourth transport paths, said shutter is moved to said fully closed position, wherein when said recording medium is fed along said third transport path, said shutter is moved to said fully open position, and wherein when said recording medium is fed along said second transport path, said shutter is moved to said intermediate open position.

12. A printer according to claim 7, wherein said body has defined therewithin a printing position where the information is printed onto said recording medium, wherein said recording medium is fed on the basis of a selected one of a first feed mode in which said recording medium is fed into said body through said rear opening, the information is printed onto said recording medium at said printing position and, subsequently, said recording medium is drawn out of said body through said rear opening, a second feed mode in which said recording medium is fed into said body through said upper opening, the information is printed onto said recording medium at said printing position and, subsequently, said recording medium is drawn out of said body through said upper opening, and a third feed mode in which said recording medium is fed into said body through said rear opening, the information is printed onto said recording medium at said printing position and, subsequently, said recording medium is drawn out of said body through said upper opening, wherein when said recording medium is fed in said first feed mode, said shutter occupies said fully closed position, wherein when said recording medium is fed in said second feed mode, said shutter occupies said fully open position, and wherein said recording medium is fed in said third feed mode, said shutter occupies said intermediate open position.

13. A printer according to claim 12, wherein said body is further formed therein with a lower insertion opening through which said recording medium can be inserted into said body, wherein said recording medium can be fed in a fourth feed mode in which said recording medium is fed into said body through said lower insertion opening, the information is printed onto said recording medium at said printing position and, subsequently, said recording medium is drawn out of said body through said rear opening, and wherein when said recording medium is fed in said fourth feed mode, said shutter occupies said fully closed position.

* * * * *